US008523211B2

(12) United States Patent
Mailahn

(10) Patent No.: US 8,523,211 B2
(45) Date of Patent: Sep. 3, 2013

(54) KNEE ROLLER

(76) Inventor: Clinton Allen Mailahn, Lincoln, NE (US)

( * ) Notice: Subject to any disclaimer, the term of this patent is extended or adjusted under 35 U.S.C. 154(b) by 4 days.

(21) Appl. No.: 13/240,251

(22) Filed: Sep. 22, 2011

(65) Prior Publication Data

US 2013/0075997 A1 Mar. 28, 2013

(51) Int. Cl.
*A63H 3/00* (2006.01)

(52) U.S. Cl.
USPC ..... 280/263; 280/87.01; 280/87.021; 280/47.19

(58) Field of Classification Search
USPC ..... 280/263, 87.01, 87.021, 47.19
See application file for complete search history.

(56) References Cited

U.S. PATENT DOCUMENTS

| | | | | |
|---|---|---|---|---|
| 5,800,317 | A * | 9/1998 | Accetta | 482/66 |
| 5,839,740 | A * | 11/1998 | Seeger | 280/87.021 |
| 6,053,189 | A * | 4/2000 | Longenecker et al. | 135/67 |
| 6,848,696 | B2 * | 2/2005 | Miller | 280/87.021 |
| 7,287,767 | B1 * | 10/2007 | Gomes et al. | 280/87.021 |
| 7,780,180 | B2 | 8/2010 | Hoepner et al. | |
| 7,938,413 | B2 | 5/2011 | Anderson | |
| 7,980,572 | B2 * | 7/2011 | Bennett | 280/87.021 |
| 7,988,163 | B2 * | 8/2011 | Accetta | 280/87.05 |
| 8,231,133 | B2 * | 7/2012 | Walther et al. | 280/87.021 |
| 2003/0137119 | A1 * | 7/2003 | Razon | 280/87.021 |
| 2004/0012165 | A1 * | 1/2004 | Miller | 280/87.01 |
| 2004/0201192 | A1 * | 10/2004 | Ramm | 280/87.021 |
| 2006/0033297 | A1 * | 2/2006 | Miller | 280/87.021 |
| 2007/0182116 | A1 * | 8/2007 | Davey et al. | 280/87.05 |
| 2008/0135077 | A1 * | 6/2008 | Meyers et al. | 135/66 |
| 2008/0284125 | A1 * | 11/2008 | Ramm et al. | 280/263 |
| 2009/0058036 | A1 * | 3/2009 | Hoepner et al. | 280/267 |
| 2010/0007104 | A1 * | 1/2010 | Bennett | 280/7.15 |

* cited by examiner

*Primary Examiner* — Kevin Hurley
*Assistant Examiner* — Michael Stabley
(74) *Attorney, Agent, or Firm* — Suiter Swantz pc llo

(57) ABSTRACT

A knee roller that is easy to use and provides improved maneuverability is disclosed. The knee roller may include a support frame for supporting a handlebar assembly, a knee support and a pair of coaxial wheels. The pair of coaxial wheels may be positioned substantially underneath the knee support, where the pair of coaxial wheels rotates about a common rotation axis, and a vertical plane defined by the rotation axis intersects the knee support. The position of the pair of coaxial wheels with respect to the knee support substantially distributes a weight received at the knee support over the pair of coaxial wheels and allows the knee roller to turn about a vertical axis perpendicular to and intersects with the rotation axis.

18 Claims, 5 Drawing Sheets

KNEE ROLLER

TECHNICAL FIELD

The disclosure generally relates to the field of ambulatory assistive devices, particularly to a self-propelled knee roller.

BACKGROUND

Various devices may be utilized to provide walking assistance to a person with physical impairments. A knee roller (may also be referred to as a knee walker or knee scooter) is one of such devices that provides support for a knee, allowing the person to rest one leg on the knee roller and utilize the other leg to propel the knee roller.

Many of the existing devices include one or more front wheels, one or more rear wheels and a cushion positioned between the front and rear wheels for supporting the knee. The front wheels in such a device may be steerable (e.g., using a handlebar) and the rear wheels may follow, allowing the user to guide the device towards a particular direction. However, the turning abilities provided in such configurations are limited (e.g., having a turning radius of a few meters), making such devices difficult to navigate and/or turn in small areas. Therein lies a need for a knee roller that is easy to use and provides improved maneuverability.

SUMMARY

The present disclosure is directed to a knee roller that is easy to use and provides improved maneuverability. The knee roller may include a support frame for supporting a handlebar assembly, a knee support and a pair of coaxial wheels. The pair of coaxial wheels may be positioned below the knee support, where the pair of coaxial wheels rotates about a common rotation axis, and a vertical plane defined by the rotation axis intersects the knee support. The position of the pair of coaxial wheels with respect to the knee support substantially distributes a weight received at the knee support over the pair of coaxial wheels and allows the knee roller to turn about a vertical axis perpendicular to and intersects with the rotation axis.

Furthermore, the position of the pair of coaxial wheels with respect to the knee support positions the vertical plane defined by the rotation axis to generally coincide with a coronal plane of the user. The position of the pair of coaxial wheels with respect to the knee support also provides zero turning radius capabilities, allowing the user to turn about a vertical axis formed by an intersection of the coronal plane of the user and a sagittal plane of the user (i.e., turn/spin around). Maneuverability is therefore improved.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
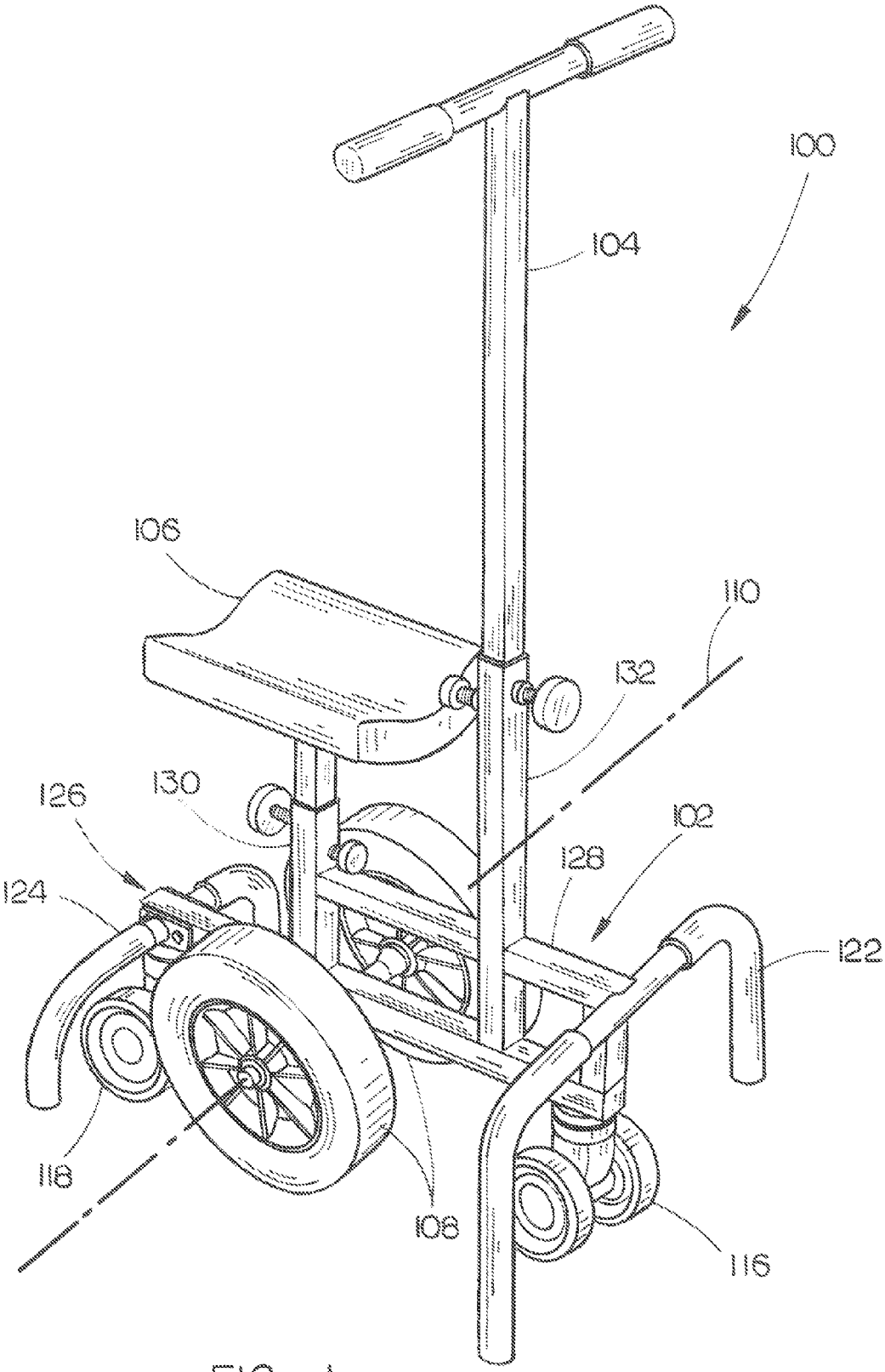
FIG. 1 is an isometric view of a knee roller in accordance with the present disclosure.

Reference will now be made in detail to the subject matter disclosed, which is illustrated in the accompanying drawings.

The present disclosure is directed to a knee roller that is easy to use and provides improved maneuverability. Certain anatomical terms are used in the present disclosure to describe locations and movements relevant to a human body. More specifically, a coronal plane (also known as the frontal plane) is an anatomical term referring to a vertical plane that divides the body into ventral and dorsal (belly and back) sections. In addition, a sagittal plane is an anatomical term referring to a vertical plane which passes from front to rear dividing the body into right and left sections.

Referring generally to FIGS. 1 through 4, a knee roller 100 in accordance with the present disclosure is shown. The knee roller 100 may include a support frame 102, a handlebar assembly 104, a knee support 106 and a pair of coaxial wheels 108 positioned below the knee support 106. The position of the pair of coaxial wheels 108 with respect to the knee support 106 allows the rotation axis 110 of the wheels 108 to generally coincide with the coronal plane 112 of the user during operation, and also allows the weight received at the knee support 106 to be substantially distributed over the pair of wheels 108. Such an arrangement allows the knee roller 100 to feel more natural to the user and allows the user to turn about a vertical axis formed by the intersection of the user's coronal plane 112 and sagittal plane 114.

In one embodiment, the handlebar assembly 104 may be adjustably attached to the support frame 102, allowing the height of the handlebar to be adjustable for different users. For instance, the handlebar assembly 104 may include a support rod with predefined apertures, and a pin may be utilized to engage one of the apertures in order to lock the handlebar assembly 104 at a desired height. Similarly, the knee support 106 may also be adjustably attached to the support frame 102, allowing the height of the knee support to be adjustable for different users. It is contemplated that various other types of mechanisms may be utilized to provide height adjustments for the handlebar assembly 104 and/or the knee support 106 without departing from the spirit and scope of the present disclosure.

As illustrated in the figures, the pair of coaxial wheels 108 is attached to the support frame 102 at a position below the knee support 106. In addition, the wheels 108 are configured to rotate about a common rotation axis 110, and a vertical plane defined by the rotation axis 110 intersects with the knee support 106. That is, in accordance with the present disclosure, the wheels 108 are positioned underneath (with respect to the orientation indicated in FIG. 1) the knee support 106. In a preferred embodiment, the vertical plane defined by the rotation axis 110 may intersect with the knee support 106 within a few (e.g., within 4) inches from the center of the knee support 106 (indicated as d1 in FIG. 4). Furthermore, the lateral distance (with respect to the orientation indicated in FIG. 4) between the handlebar assembly 104 and the center of the knee support 106 (indicated as d2 in FIG. 4) may be configured to be less than or about the length of the user's forearm (or about 7 to 15 inches), allowing the user to comfortably rest the arms on the handlebar when using the knee roller 100.

Figure 3:
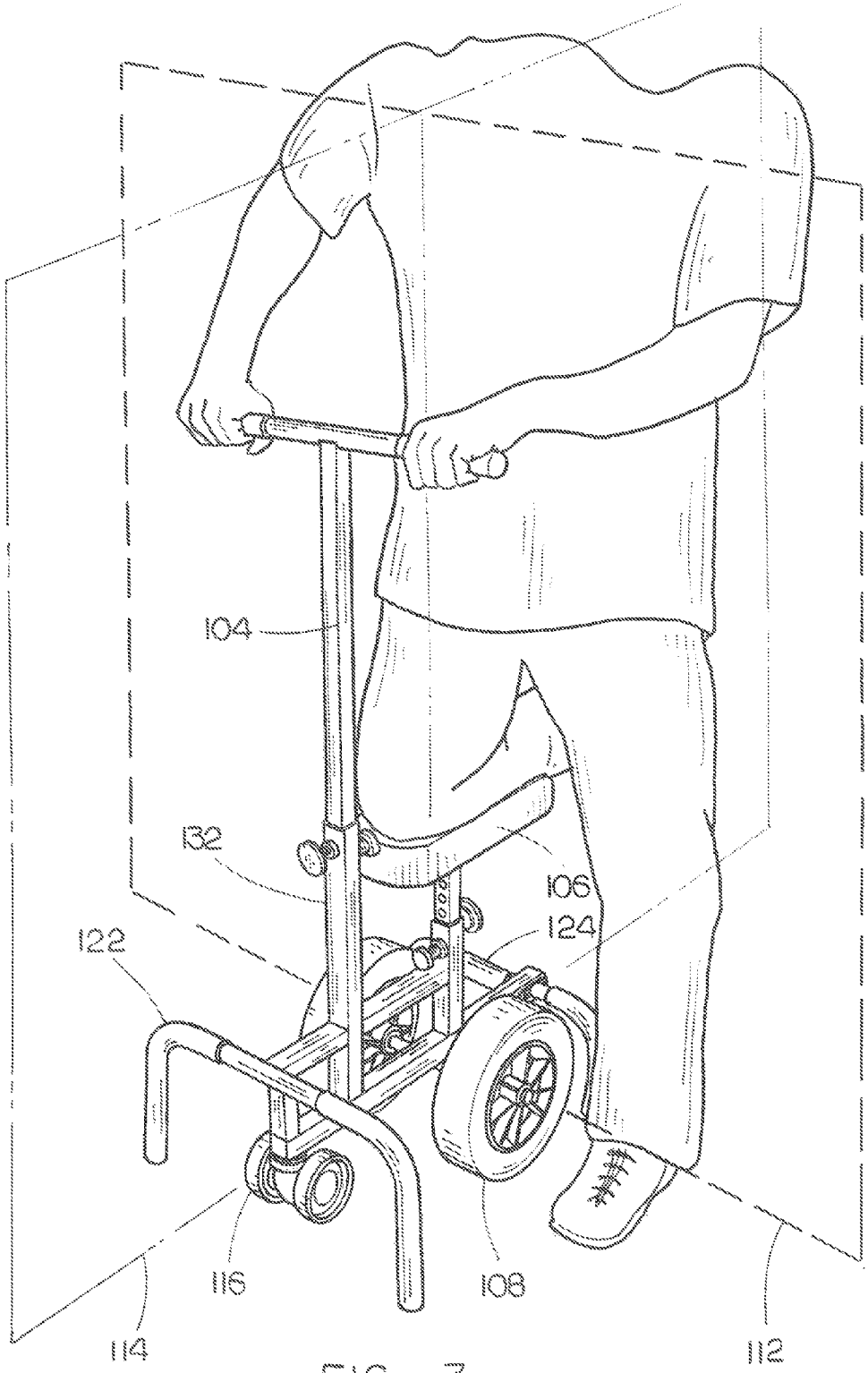
FIG. 3 is an illustration depicting the knee roller being utilized.
Figure 4:
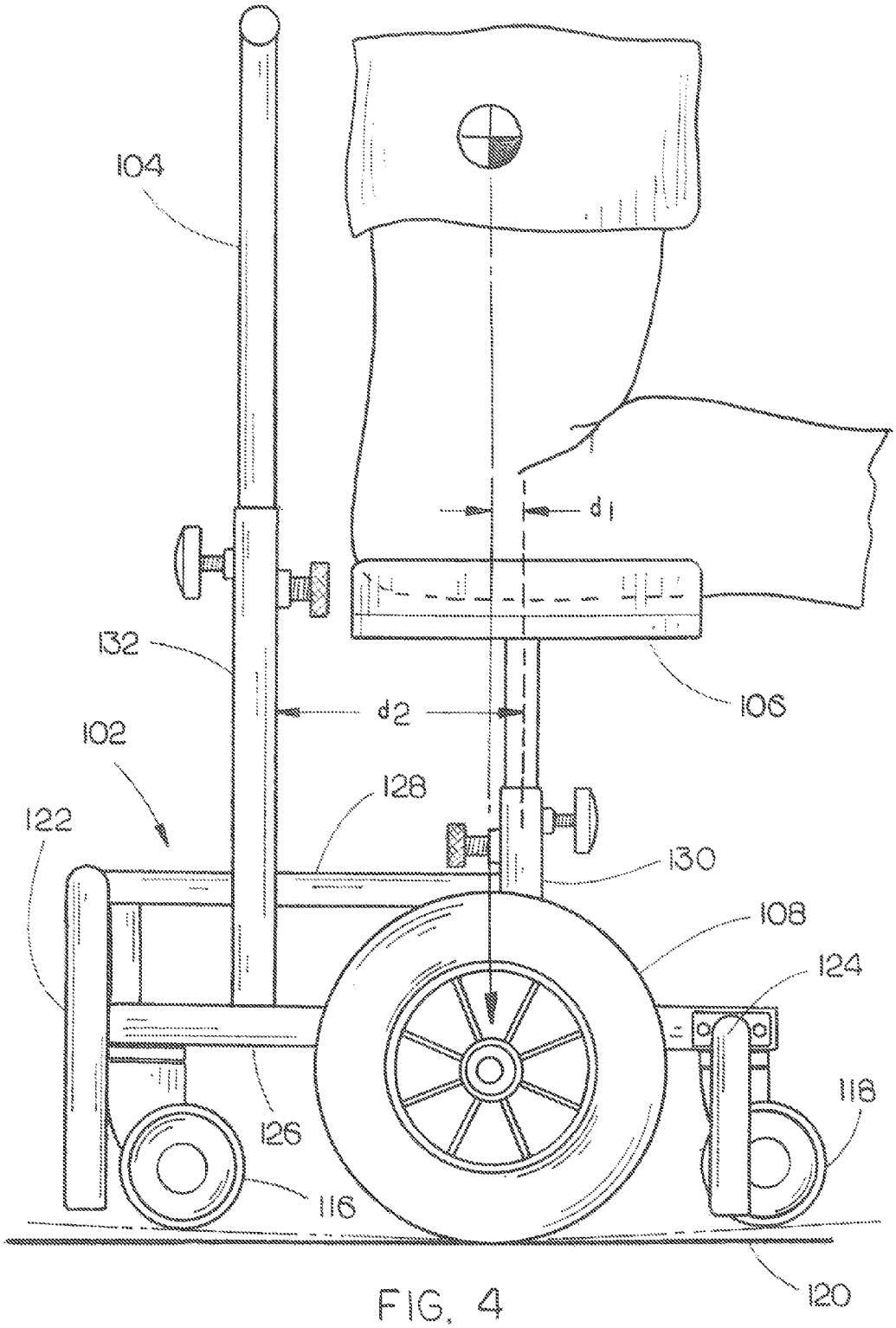
FIG. 4 is a side elevation view of the knee roller.

The position of the wheels 108 with respect to the knee support 106 allows the vertical plane defined by the rotation axis 110 to generally coincide with the coronal plane of the user when the user places a knee on the knee support 106 (as shown in FIGS. 3 and 4). This arrangement makes the knee roller 100 feel more natural to the user as the knee support 106 and the wheels 108 together provide an extension from the user's thigh, allowing the weight received at the knee support 106 to be substantially distributed along this extension.

Figure 5:
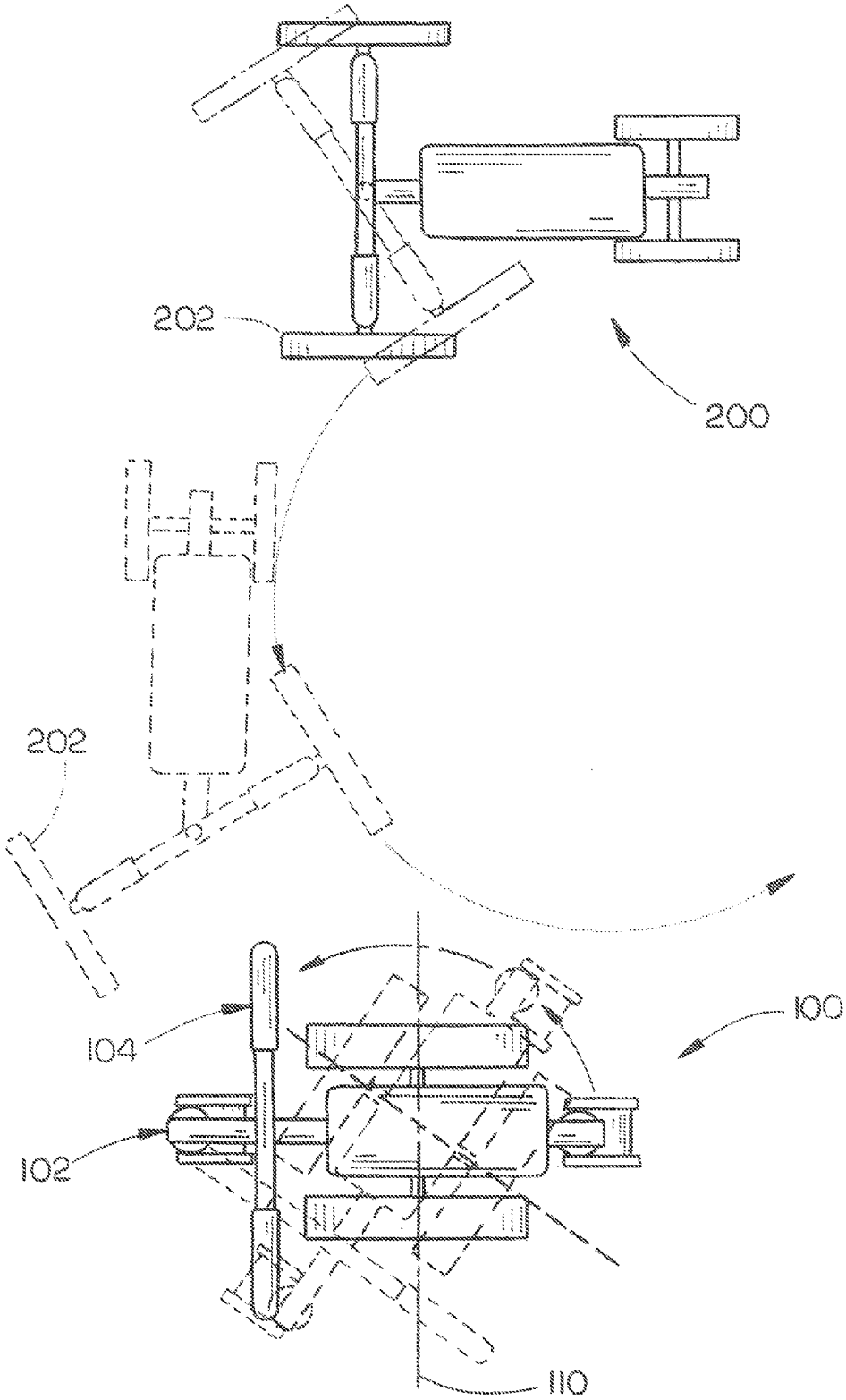
FIG. 5 is an illustration depicting maneuverability of the knee roller in accordance with the present disclosure in comparison with a conventional device.

This arrangement also provides improved maneuverability for the user when using the knee roller 100. As illustrated in FIG. 5, instead of utilizing front wheels 202 to guide the path as in a conventional roller 200, the knee roller 100 in accordance with the present disclosure does not utilizes such front wheels, and the handlebar assembly 104 is configured to be non-pivotal relative to the support frame 102. The knee roller 100 in accordance with the present disclosure is configured to respond to the propulsion provided by the user and is able to turn about a vertical axis perpendicular to and intersects with the rotation axis 110. Therefore, zero turning radius is achieved, which may be appreciated in various situations.

For instance, in situations where available space may be limited, the knee roller 100 in accordance with the present disclosure may allow the user to navigate around tight corners or the like. In another example, the user utilizing the knee roller 100 is able to turn around without having to circle around as the case with a conventional device. That is, the knee roller 100 allows the user to turn about a vertical axis formed by the intersection of the user's coronal and sagittal planes (i.e., turn/spin around). Furthermore, the knee roller 100 in accordance with the present disclosure does not require any upper body movement in order to properly operate the roller. The rotation axis 110 of the wheels 108 stays generally parallel with the user's shoulders during operation and the user may keep the upper body position unchanged even when turning.

It is contemplated that one or more auxiliary wheels may be utilized to provide additional support if needed. In one embodiment, two auxiliary wheels, 116 and 118, are positioned towards the front and the rear of the support frame 102, respectively. As illustrated in FIG. 4, the auxiliary wheels 116 and 118 are configured to conditionally engage the ground 120. More specifically, when the knee roller 100 is held straight up, the auxiliary wheels 116 and 118 may be suspended above the bottom of the coaxial wheels 108 where the coaxial wheels 108 engage the ground 120, and the weight received at the knee support 106 may be distributed entirely over the coaxial wheels 108.

However, the user may lean slightly forward (e.g., when propelling the knee roller 100 forward), in which case the knee roller 100 may also lean slightly forward, allowing the auxiliary wheel 116 to engage with the ground 120 and to swivel based on the direction of travel of the knee roller 100. Utilizing the auxiliary wheel 116 may help preventing the knee roller 100 from inadvertently tipping forward. Similarly, the user may lean slightly backwards, in which case the knee roller 100 may also lean slightly backwards, allowing the auxiliary wheel 118 to engage with the ground 120 and to swivel based on the direction of travel of the knee roller 100. Utilizing the auxiliary wheel 118 may help preventing the knee roller 100 from inadvertently tipping backward.

It is contemplated that the two auxiliary wheels depicted in the figures are merely exemplary. Fewer or additional auxiliary wheels may be utilized. It is also understood that the particular type of auxiliary wheels depicted in the figures is merely exemplary. Various types of swivel wheels may be utilized without departing from the spirit and scope of the present disclosure. Furthermore, the ground 120 referenced in the description above generally refers to a plane that the coaxial wheels 108 and the auxiliary wheels 116 and 118 may engage. It is understood that different surface conditions may provide slightly different riding conditions. For instance, if the knee roller 100 is utilized on a soft surface (e.g., carpet or the like), the auxiliary wheels 116 and 118 may contact the surface even when the knee roller 100 is held straight up.

It is further contemplated that one or more tilt prevention arms may be utilized to help preventing the knee roller 100 from inadvertently tipping sideways. In one embodiment, two tilt prevention arms, 122 and 124, are positioned at the front and the rear of the support frame 102, respectively. As illustrated in FIG. 4, the tilt prevention arms 122 and 124 are not configured to engage the ground plane 120 when both of the coaxial wheels 108 are on the ground (including the situations when the knee roller 100 leans slightly forward/backward as described above). However, if one of the coaxial wheels 108 is lifted off the ground while the other remains on the ground, the knee roller 100 may be at a tilted position which may not be desirable. The tilt prevention arms 122 and 124 may be configured to establish contact with the ground if the knee roller 100 is tilted sideways beyond an allowed limit, providing support for the knee roller 100 and helping to prevent falling.

It is contemplated that protective sleeves may be utilized to cover and protect at least a portion of the tilt prevention arms 122 and 124. In addition, a replaceable tip (made of plastic, rubber, metal or the like) may be utilized to protect the end of each tilt prevention arm where it may potentially engage with the ground. It is understood that such replaceable tips may be secured to the tilt prevention arms utilizing screws, snap fit mechanisms, friction fit mechanisms or the like.

Figure 2:
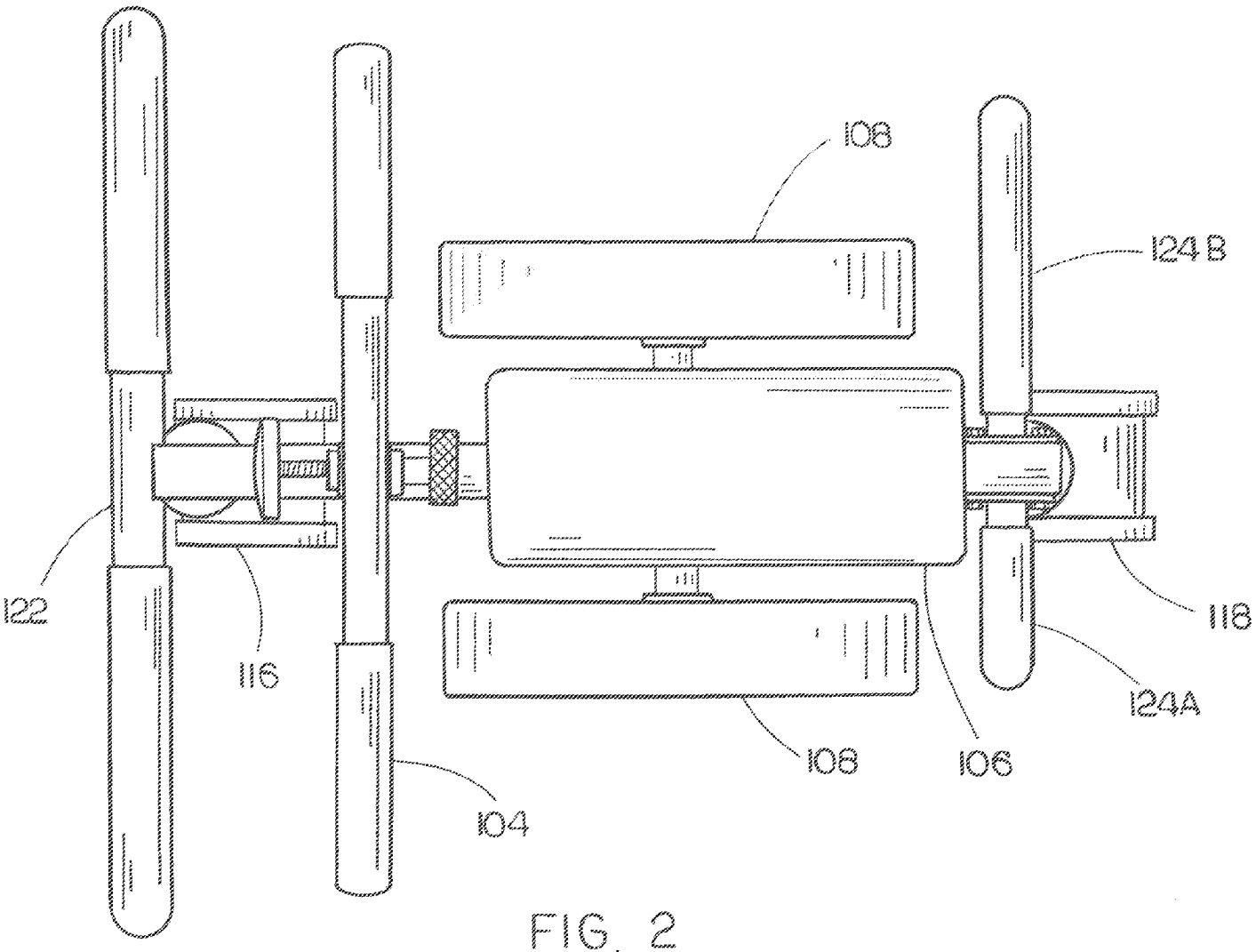
FIG. 2 is a top view of the knee roller.

Furthermore, as illustrated in FIG. 2, the tilt prevention arm 124 positioned at the rear of the support frame 102 may be configured to accommodate for movements of the user's ground engaging leg (i.e., the leg that is not placed on the knee support 106). For instance, the tilt prevention arm 124 may include a short arm 124A and a long arm 124B. The short arm 124A may be mounted to the side of the support frame 102 where the user's ground engaging leg is to be located, thus providing more freedom of movements for that leg. The long arm 124B may be mounted to the support frame 102 on the opposite side. It is contemplated that the short arm 124A and the long arm 124B may be configured to be adjustable/interchangeable parts, providing freedom of movements for the user whether the ground engaging leg is the user's right leg or left leg.

It is contemplated that the support frame 102 may be structured in various ways. The support frame 102 in a particular embodiment may include a first (lower) support bar 126 configured for receiving the pair of coaxial wheels 108. The first support bar 126 may also define a receptacle 130 for receiving the knee support 106 and a receptacle 132 for receiving the handlebar assembly 104. The auxiliary wheels 116 and 118 may also be mounted to the first support bar 126. The support frame 102 may also include a second (upper) support bar 128 positioned above and generally parallel to the first support bar 126. The upper support bar 128 may provide additional structural support for the knee support receptacle 130 and the handlebar assembly receptacle 132. However, it is understood that such a structural implementation of the support frame 102 is merely exemplary; various other structural implementations may be utilized to form the support frame 102 without departing from the spirit and scope of the present disclosure.

It is understood that the present disclosure is not limited to any underlying implementing technology. The present disclosure may be implemented using a variety of technologies without departing from the scope and spirit of the disclosure or without sacrificing all of its material advantages.

It is believed that the present disclosure and many of its attendant advantages will be understood by the foregoing description, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A knee roller, comprising:

a support frame;

a handlebar assembly adjustably attached to the support frame, the handlebar assembly being non-pivotal relative to the support frame;

a knee support adjustably attached to the support frame, the knee support configured for supporting a knee of a user;

a pair of coaxial wheels attached to the support frame at a position below the knee support, where the pair of coaxial wheels rotates about a common rotation axis, and a vertical plane defined by the rotation axis intersects the knee support;

a first auxiliary wheel positioned towards a front end of the support frame, the first auxiliary wheel configured to swivel based on a direction of travel of the knee roller when the first auxiliary wheel engages a ground surface;

a second auxiliary wheel positioned towards a rear end of the support frame, the second auxiliary wheel configured to swivel based on the direction of travel of the knee roller when the second auxiliary wheel engages the ground surface;

wherein a tangential plane formed by a point of contact of the first auxiliary wheel and points of contact of the pair of coaxial wheels is different from a tangential plane formed by a point of contact of the second auxiliary wheel and the points of contact of the pair of coaxial wheels, allowing the first and second auxiliary wheels to conditionally engage the ground surface; and wherein the position of the pair of coaxial wheels with respect to the knee support substantially distributes a weight received at the knee support over the pair of coaxial wheels and allows the knee roller to turn about a vertical axis perpendicular to and intersects with the rotation axis.

2. The knee roller of claim 1, further comprising:

a first tilt prevention arm positioned at a front end of the support frame, the first tilt prevention arm configured to establish contact with a ground surface when the knee roller is tilted sideways beyond an allowed limit.

3. The knee roller of claim 2, further comprising:

a second tilt prevention arm positioned at a rear end of the support frame, the second tilt prevention arm configured to establish contact with the ground surface when the knee roller is tilted sideways beyond the allowed limit.

4. The knee roller of claim 3, wherein the second tilt prevention arm includes interchangeable arm parts.

5. The knee roller of claim 1, wherein the vertical plane defined by the rotation axis intersects with the knee support within approximately 4 inches from a center of the knee support.

6. The knee roller of claim 5, wherein the lateral distance between the handlebar assembly and the center of the knee support is between approximately 7 to 15 inches.

7. A knee roller, comprising:

a support frame;

a handlebar assembly adjustably attached to the support frame, the handlebar assembly being non-pivotal relative to the support frame;

a knee support adjustably attached to the support frame, the knee support configured for supporting a knee of a user;

a pair of coaxial wheels attached to the support frame at a position below the knee support, where the pair of coaxial wheels rotates about a common rotation axis, and a vertical plane defined by the rotation axis intersects the knee support;

a first auxiliary wheel positioned towards a front end of the support frame, the first auxiliary wheel configured to swivel based on a direction of travel of the knee roller when the first auxiliary wheel engages a ground surface; and a second auxiliary wheel positioned towards a rear end of the support frame, the second auxiliary wheel configured to swivel based on the direction of travel of the knee roller when the second auxiliary wheel engages the ground surface;

wherein the position of the pair of coaxial wheels with respect to the knee support positions the vertical plane defined by the rotation axis to generally coincide with a coronal plane of the user and allows the user to turn about a vertical axis formed by an intersection of the coronal plane of the user and a sagittal plane of the user; and wherein a tangential plane formed by a point of contact of the first auxiliary wheel and points of contact of the pair of coaxial wheels is different from a tangential plane formed by a point of contact of the second auxiliary wheel and the points of contact of the pair of coaxial wheels.

8. The knee roller of claim 7, further comprising:

a first tilt prevention arm positioned at a front end of the support frame, the first tilt prevention arm configured to establish contact with a ground surface when the knee roller is tilted sideways beyond an allowed limit.

9. The knee roller of claim 8, further comprising:

a second tilt prevention arm positioned at a rear end of the support frame, the second tilt prevention arm configured to establish contact with the ground surface when the knee roller is tilted sideways beyond the allowed limit.

10. The knee roller of claim 9, wherein the second tilt prevention arm includes interchangeable arm parts.

11. The knee roller of claim 7, wherein the vertical plane defined by the rotation axis intersects with the knee support within approximately 4 inches from a center of the knee support.

12. The knee roller of claim 11, wherein the lateral distance between the handlebar assembly and the center of the knee support is between approximately 7 to 15 inches.

13. A knee roller, comprising:

a support frame;

a handlebar assembly adjustably attached to the support frame, the handlebar assembly being non-pivotal relative to the support frame;

a knee support adjustably attached to the support frame, the knee support configured for supporting a knee of a user;

a pair of coaxial wheels attached to the support frame at a position substantially underneath the knee support, where the pair of coaxial wheels rotates about a common rotation axis, and a vertical plane defined by the rotation axis intersects the knee support;

a first auxiliary wheel positioned towards a front end of the support frame, the first auxiliary wheel configured to swivel based on a direction of travel of the knee roller when the first auxiliary wheel engages a ground surface;

a second auxiliary wheel positioned towards a rear end of the support frame, the second auxiliary wheel configured to swivel based on the direction of travel of the knee roller when the second auxiliary wheel engages the ground surface; and a plurality of tilt prevention arms configured to establish contact with the ground surface when the knee roller is tilted sideways beyond an allowed limit;

wherein a tangential plane formed by a point of contact of the first auxiliary wheel and points of contact of the pair of coaxial wheels is different from a tangential plane formed by a point of contact of the second auxiliary wheel and the points of contact of the pair of coaxial wheels, allowing the first and second auxiliary wheels to conditionally engage the ground surface; and wherein the position of the pair of coaxial wheels with respect to the knee support positions the vertical plane defined by the rotation axis to generally coincide with a coronal plane of the user, substantially distributes a weight received at the knee support over the pair of coaxial wheels, and allows the user to turn about a vertical axis formed by an intersection of the coronal plane of the user and a sagittal plane of the user.

14. The knee roller of claim 13, wherein the first auxiliary wheel and the second auxiliary wheel are configured to conditionally engage the ground surface.

15. The knee roller of claim 13, wherein the plurality of tilt prevention arms further comprises a first tilt prevention arm positioned at the front end of the support frame.

16. The knee roller of claim 15, wherein the plurality of tilt prevention arms further comprises a second tilt prevention arm positioned at the rear end of the support frame.

17. The knee roller of claim 16, wherein the second tilt prevention arm includes interchangeable arm parts.

18. The knee roller of claim 13, wherein the vertical plane defined by the common rotation axis intersects with the knee support within approximately 4 inches from a center of the knee support.

* * * * *